US006722856B2

(12) United States Patent
Schneider

(10) Patent No.: US 6,722,856 B2
(45) Date of Patent: Apr. 20, 2004

(54) VANE-CELL PUMP

(75) Inventor: Willi Schneider, Bad Neustadt (DE)

(73) Assignee: Joma-Hydromechanic GmbH, Bodelhausen (DE)

( * ) Notice: Subject to any disclaimer, the term of this patent is extended or adjusted under 35 U.S.C. 154(b) by 20 days.

(21) Appl. No.: 10/203,172

(22) PCT Filed: Mar. 20, 2001

(86) PCT No.: PCT/EP01/03178

§ 371 (c)(1),
(2), (4) Date: Aug. 7, 2002

(87) PCT Pub. No.: WO02/01074

PCT Pub. Date: Jan. 3, 2002

(65) Prior Publication Data

US 2003/0012665 A1 Jan. 16, 2003

(30) Foreign Application Priority Data

Jun. 26, 2000 (DE) ..... 100 29 969

(51) Int. Cl.[7] ..... F04C 15/02
(52) U.S. Cl. ..... 417/220; 418/30
(58) Field of Search ..... 417/220; 418/30

(56) References Cited

U.S. PATENT DOCUMENTS 4,679,995 A * 7/1987 Bristow ..... 418/30

FOREIGN PATENT DOCUMENTS

| | | |
|---|---|---|
| DE | 33 33 647 | 5/1984 |
| DE | 40 14 636 | 7/1992 |
| DE | 42 01 257 | 7/1993 |
| DE | 295 14 202 | 10/1995 |
| DE | 195 32 703 | 11/1996 |
| DE | 195 33 686 | 3/1997 |

* cited by examiner

*Primary Examiner*—Michael Koczo
(74) *Attorney, Agent, or Firm*—Paul Vincent

(57) ABSTRACT

The invention relates to a vane-cell pump comprising a pump rotor (20), provided with a radially displaceable rotor blade (22). Said pump rotor is mounted in a pump stator (12) which can be pivoted inside a pump bearing house (10) around a stationary pivotal axis (34) in a radial position with regard to said pump rotor. A control device (30) is associated with the pump stator (12) for automatic pressure adjustment. Said control device has an actuating member protruding on the outside, therefrom, perpendicular to the pivotal axis thereof. The actuating member forms a pivoting piston (38) in a guide element (10) of the pumpbearing housing (10) which is directly impinged upon by a pumping medium. The pivotable piston can pivot in a direction against the action of a pressure spring (50).

4 Claims, 2 Drawing Sheets

VANE-CELL PUMP

BACKGROUND OF THE INVENTION

The invention concerns a vane-cell pump in accordance with the features of the independent claim.

DE 33 33 647 A1 discloses a vane-cell pump having these structural features whose construction guarantees that the amount and pressure of a liquid medium to be supplied, e.g. lubricant for pressure lubrication, are automatically adjusted to the requirements and the respective state of a unit to be lubricated, e.g. a combustion engine.

Towards this end, the stator, which can be pivoted radially relative to the rotor for pressure control, is correspondingly displaced by an actuator. An actuating piston of the pressure regulating device is guided in a guiding cylinder of the pump bearing housing and acts on the actuator. The cylinder space is thereby in permanent communication with the pressure side of the vane-cell pump via a channel. The pressure regulating device has at least one pressure spring, forming a stop and acting on the actuator as a counter force in opposition to the piston. It is supported on one side by the bottom of a further guiding cylinder which is coaxial to the guiding cylinder of the actuating piston, and on the other side by a counter piston guided therein and communicating with the actuator.

Corresponding pretension of the pressure spring of the pressure regulating device adjusts the supply pressure in dependence on the spring characteristics.

The pressure regulating device of this known vane-cell pump requires a significant degree of technical and assembly effort with a correspondingly large amount of space being required for accommodating the two coaxially guided actuating and counter pistons in the pump bearing housing.

It is therefore the underlying purpose of the invention to substantially simplify the construction of the pressure regulating device for vane-cell pumps of the type recited in the independent claim.

SUMMARY OF THE INVENTION

This object is achieved with a vane-cell pump having the features of the independent claim.

In the inventive construction, the pressure regulating device comprises only one actuator in the form of a pivot piston guided in the guide of the pump bearing housing in a pressure and liquid-tight fashion which is directly loaded by the pressure medium. The stored energy can act directly as a counter force on the pump stator e.g. at a suitable location in the bearing housing.

In the most simple form, the inventive construction requires only one single pressure and liquid-tight pivotable actuator for controlled pivoting of the pump stator and at least one energy accumulator which can be accommodated in the pump bearing housing at a freely selectable location relative to the pump stator.

The pump stator can thereby form a one-armed or two-armed lever wherein, in the latter case, the lever arm facing away from the pump rotor can form the pivot piston.

The pivot piston will preferably be operated in opposition to at least one pressure spring which is supported thereon to produce the stored energy.

This accumulated energy can thereby vary to permit variable adjustment of the maximum supply pressure.

This can be effected by serially switching pressure springs in steps or by providing a pressure spring which can be gradually pretensioned.

The pump stator can be disposed in the bearing housing on a pivot axis which is fixed to the housing or, with a partially cylindrical hinge section provided between its two lever arms, can be brought into positive engagement with two mutually opposite bearing surfaces of the pump bearing housing which are fixed to that housing.

The essential features and details of the invention can be extracted from embodiments of vane-cell pumps which are shown in the drawings in an exemplary and simplified fashion.

DESCRIPTION OF THE PREFERRED EMBODIMENT

Figure 1A:
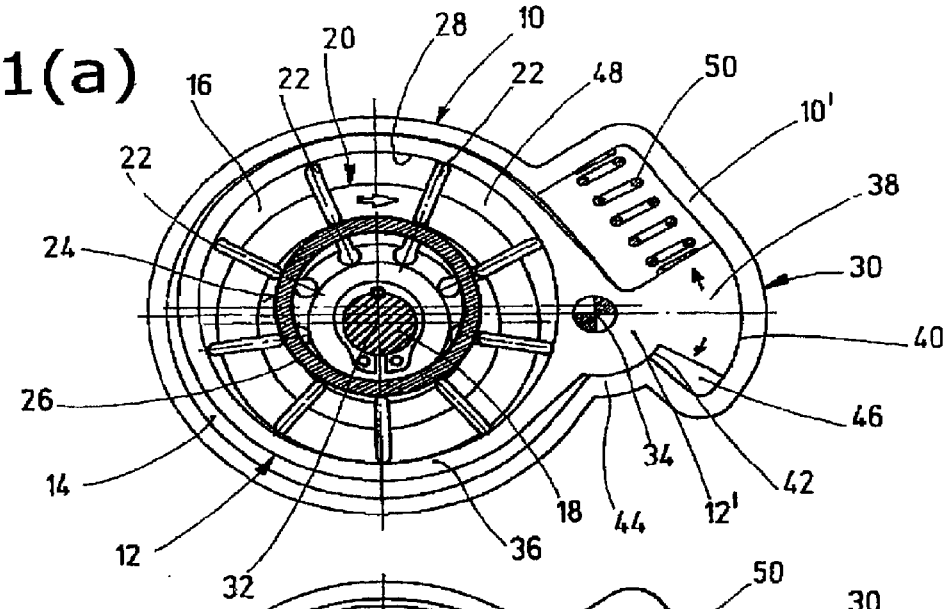
FIG. 1 shows a cross-section through the vane-cell pump wherein illustrations a) to c) show different positions of the pump stator for adjusting the supply volume as produced by the pressure regulating device.
Figure 1B:
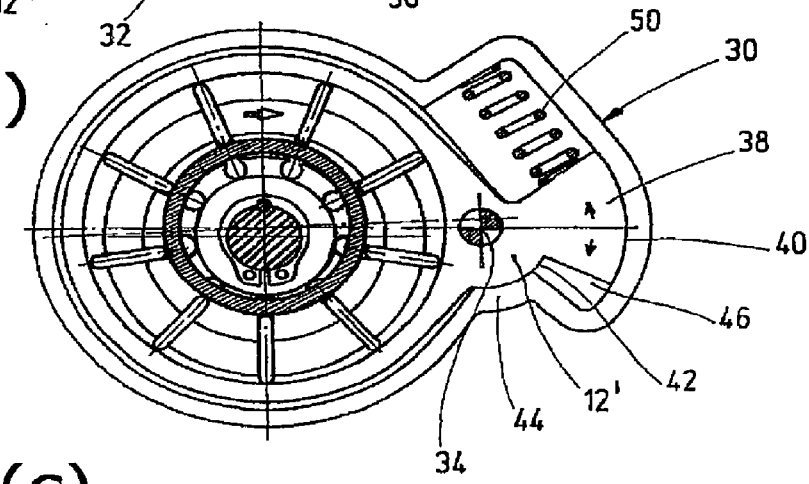
Figure 1C:
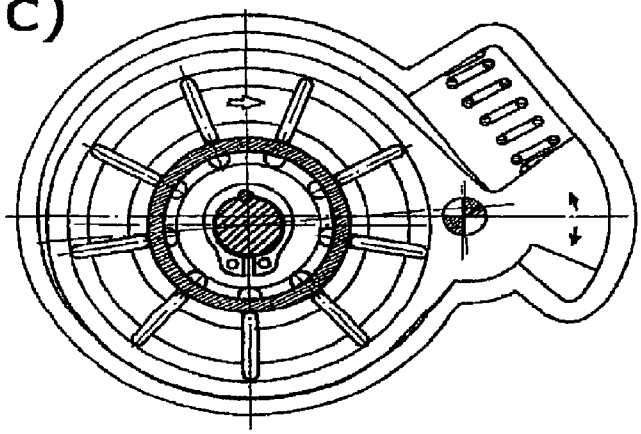
Figure 2:
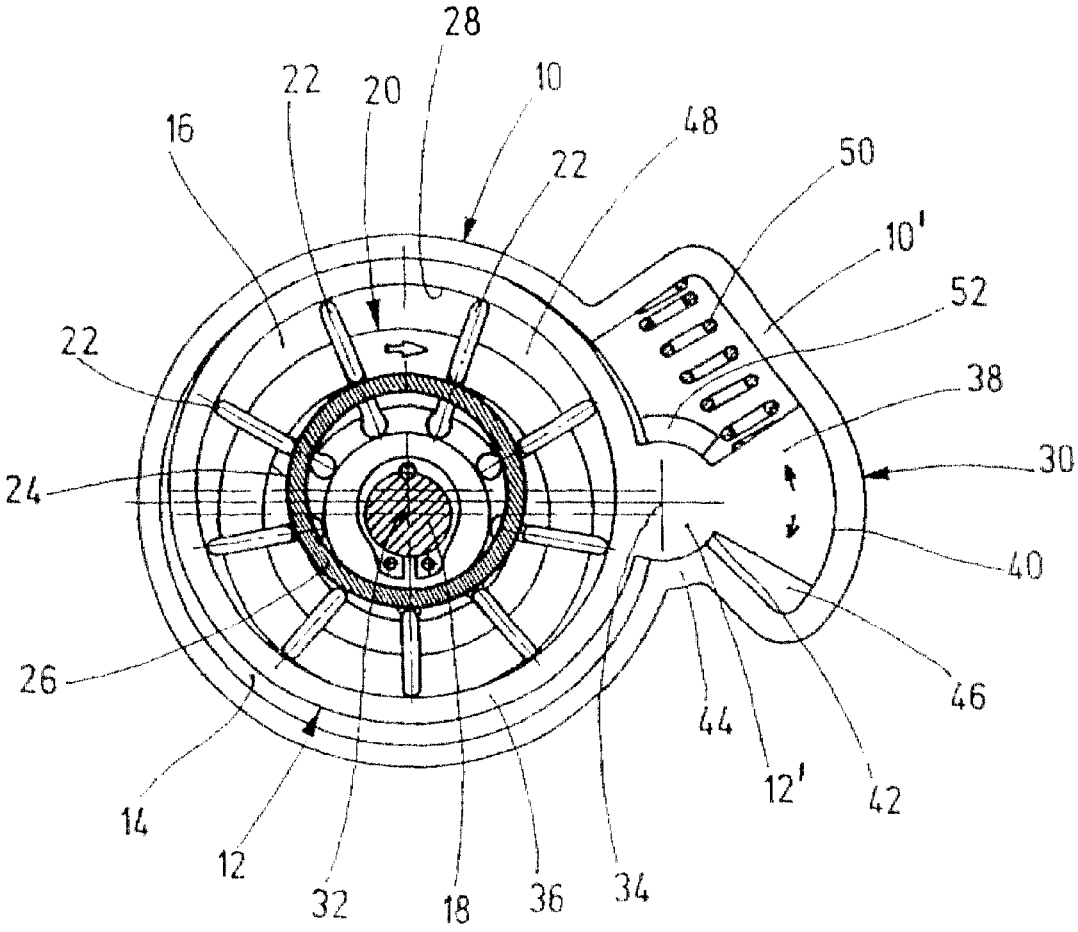
FIG. 2 shows a cross-section of another embodiment of the vane-cell pump.

The vane-cell pumps shown in FIGS. 1 and 2 have identical main constructional features, having a preferably hollow-cylindrical pump bearing housing 10 whose circular cylindrical housing interior 14 accommodates a pump stator 12 and is closed at the ends by flat end faces in a manner known per se and, analogous to the construction of DE 33 33 647 A1, is connected to a pressure and suction line (not shown for reasons of simplicity).

The pump stator 12 contains a circular-cylindrical rotor chamber 16 in which a rotor 20 is disposed, preferably slightly eccentrically, to be driven by the pump drive shaft 18 disposed in the end walls of the pump bearing housing 10. Conventionally, the rotor 20 has a plurality of radially displaceable plate-like rotor blades 22 about its periphery each of whose two ends engages one circular guiding path 24 in the rotor chamber 16 which are provided on both chamber end walls of the rotor chamber 16 which are mutually coaxial and stationary. The guiding paths 24 are preferably defined by annular collars 26 which are formed on the end walls of the rotor chamber 16.

Cooperation between the guiding paths 24 and the blade ends ensures that, even when the rotor has stopped, the rotor wings 22 are located in a radial position with respect to the peripheral wall 28 of the rotor chamber 16 to assure that a flow medium is immediately pumped when the rotor starts turning.

A regulating device, referred to in its totality with 30, serves for automatic regulation of the supply amount by means of which the position of the rotor chamber peripheral wall 28, the annular collars 26 and the pump stator 12 can be preferably continuously varied relative to that of the rotor 20.

Towards this end, the pump stator 12 can be pivoted in the pump bearing housing 10 about a pivot axis 34 which is parallel to the rotor axis 32 and fixed to the housing.

In the embodiments shown, the pump stator 12 forms a double-armed lever whose one lever arm 36 accommodates the rotor chamber 16, while its other lever arm 38 is part of the regulating device and serves the function of a pivot piston for pivoting the pump stator 12.

This lever arm 38 is sector-shaped and guided in a guiding housing part 10' formed about the periphery of the pump bearing housing 10 in a pressure and liquid-tight fashion wherein the separation between its piston outer surface 40 and pivot axis 34 determines its radius of curvature.

The part 12' of the pump stator 12 which is provided in the transition region of the two lever arms 36 and 38 and which accommodates the pivot axis 34, abuts with a corresponding partially circular convex curvature 42 on a complementary wall part 44 of the guiding housing part 10' in a pressure and liquid tight fashion thereby forming a pressure space 46 for the loading of the pivot piston 38 with a flow medium which is in permanent communication with the pump pressure side (at 48) via a connecting or regulating channel (not shown for reasons of clarity).

An energy storing means, preferably in the form of at least one pressure spring 50, is disposed on the piston side opposite to the pressure space 46 and is supported on the pivot piston 38 for generating the counter force required for regulation. The other end of the pressure spring 50 abuts a corresponding wall part of the guiding housing part 10' to urge the pump stator 12 towards a pivoted position relative to the pump rotor 20, i.e. towards the stop position in the interior 14 of the pump bearing housing 10 having maximum pump output (see FIG. 1(*a*)).

The regulation device 30 thereby ensures that the supply amount and the work pressure are automatically adjusted to the given requirements.

FIG. 1(*b*) shows e.g. the automatic setting of the pump stator 12 if only half the pump output is required in correspondence with the conditions.

FIG. 1(*c*) shows setting of the pump stator 12 with an output of zero.

The embodiment of the vane-cell pump of FIG. 2 has a sole structural difference concerning the pivot bearing and the part 12' of the double-armed pump stator 12 which receives the pivot axis 34. In this case, the stator part 12' forms a partially cylindrical hinged section which positively engages two mutually opposed segment-shaped bearing surfaces formed on the pump bearing housing 10, one of which is formed by the wall part 44 of the pump bearing housing 10' and the other is labelled with 52. It is thereby important that the bearing overlap is >180°.

Clearly, this invention can be applied to vane-cell motors in the same advantageous fashion.

I claim:

1. A vane-cell pump for a pumped medium, the pump comprising:

a housing;

a double armed lever mounted in said housing to pivot about a stationary pivot axis disposed between a first and a second lever arm thereof, said first lever arm defining a pump stator having a rotor chamber with an inlet and an outlet, said second lever arm defining a pivot piston external to said pump stator and projecting transverse to said pivot axis, said pivot piston borne in said housing, said housing defining a first side of said pivot piston communicating with pumped medium of a pressure-side of said rotor chamber, and said housing defining a second side of said pivot piston; energy storage means disposed at said second side of said pivot piston to load said pivot piston in opposition to pressure exercised by pumped medium at said first pivot piston side; a pump rotor disposed in said rotor chamber, said pump rotor having a plurality of radially displaceable rotor blades; and a drive shaft passing into said housing and cooperating with said pump rotor, wherein said double armed lever forms a regulation system for automatic pressure control of the vane-cell pump, said second lever arm constituting an actuator of said regulation system to radially pivot said pump stator relative to said pump rotor.

2. The vane-cell pump of claim 1, wherein said energy storage means comprises a compression spring seating on said pivot piston to pivot said piston for one of continuous and stepwise change of stored energy.

3. The vane-cell pump of claim 1, wherein said pivot axis is fixed to said housing.

4. The vane-cell pump of claim 1, wherein said double armed lever comprises a partially cylindrical hinge section disposed between said first and said second lever arms, said hinge section in positive engagement with two opposite segment-shaped bearing surfaces of said housing.

* * * * *